US012221859B2

(12) United States Patent
Liu et al.

(10) Patent No.: US 12,221,859 B2
(45) Date of Patent: Feb. 11, 2025

(54) BALL-CLAMP TYPE FALL ARRESTER FOR DRILL PIPE

(71) Applicant: Guangdong Eagler Geological Equipment Technology Co., Ltd, Guangdong (CN)

(72) Inventors: Xuyong Liu, Guangdong (CN); Youlin Li, Guangdong (CN); Guanghong Deng, Guangdong (CN)

(73) Assignee: Guangdong Eagler Geological Equipment Technology Co., Ltd, Zhuhai (CN)

( * ) Notice: Subject to any disclaimer, the term of this patent is extended or adjusted under 35 U.S.C. 154(b) by 0 days.

(21) Appl. No.: 18/207,684

(22) Filed: Jun. 9, 2023

(65) Prior Publication Data

US 2023/0399923 A1 Dec. 14, 2023

(30) Foreign Application Priority Data

Jun. 13, 2022 (CN) ..... 202210665592.3

(51) Int. Cl.
*E21B 40/00* (2006.01)

(52) U.S. Cl.
CPC ..... *E21B 40/00* (2013.01)

(58) Field of Classification Search
CPC ..... E21B 40/00; E21B 19/10; E21B 19/06
See application file for complete search history.

(56) References Cited

U.S. PATENT DOCUMENTS 5,967,477 A * 10/1999 Walmsley ..... F16L 37/0927 248/230.2
6,305,649 B1 * 10/2001 Walmsley ..... E21B 19/10 248/313
6,352,115 B1 * 3/2002 Mathieu ..... E21B 43/0107 205/382
2004/0094957 A1 * 5/2004 Walmsley ..... F16L 37/23 285/307
2007/0261857 A1 * 11/2007 Kuttel ..... E21B 19/06 166/380
2014/0196909 A1 7/2014 Ellis et al.
2023/0160282 A1 * 5/2023 Al Harthi ..... E21B 40/00 166/381
2023/0399923 A1 12/2023 Liu et al.

OTHER PUBLICATIONS

Office Action dated Jun. 19, 2024 for Corresponding Australian Application No. 2023203614.
Office Action dated Oct. 18, 2024 for Corresponding Canadian Application No. 3,202,925.

* cited by examiner

*Primary Examiner* — Brad Harcourt

(57) ABSTRACT

The present invention discloses a ball-clamp type fall arrester for a drill pipe, which includes a base and a steel ball seat arranged in the base. The steel ball seat is provided with a liftable steel ball frame. A side wall of the steel ball frame is provided with a plurality of limit hole. An inner wall of the steel ball seat is provided with a guide ramp. The plurality of limit holes are respectively provided with a plurality of steel balls which are movable radially. When the steel ball frame is lifted or lowered, a radial position of each steel ball in a corresponding limit hole is positioned by the guide ramp.

13 Claims, 6 Drawing Sheets

BALL-CLAMP TYPE FALL ARRESTER FOR DRILL PIPE

CROSS REFERENCE OF RELATED APPLICATIONS

The present application claims priority of Chinese Invention Application No. 202210665592.3, filed on Jun. 13, 2022, the entire contents of which are hereby incorporated by reference.

TECHNICAL FIELD

The present invention relates to the technical field of drilling apparatus, and in particular to a ball-clamp type fall arrester for a drill pipe.

BACKGROUND

In the geological survey drilling technology, a trip drill is also called an elevatable drill tool. When the drilling process has come to an end, worn drill bits need to be replaced, rock cores need to be extracted, troubleshooting in the hole (well) is required, or other purposes, the operation of lifting the drill tool that has moved in the hole (well) to the ground is called as raising the drill tool, while the operation of moving the drill tool into the hole (well) is called as lowering the drill tool. In actual operations, the power head lifts the drill string by a distance when raising the drill tool, and screw threads at both ends of the drill pipe are released to unload the drill pipe. Then the power head moves down again to connect a next drill pipe through the screw threads, and the operation is repeated until all the drill pipes and drill tools within the hole are taken out. In case that the screw thread of the power head is not connected or not firmly connected to the screw thread of the next drill pipe during this process, but the drill pipe damper is unfastened in advance due to equipment failure or operator's misoperation at this moment, it will cause the drill pipe or drill tool below the power head to slip off and fall into the hole, resulting in a drill-falling accident, which affects the production and causes a loss.

SUMMARY

An object of the present invention is to provide a ball-clamp type fall arrester for a drill pipe. Through movable cooperation of an inverted conical guide ramp and steel balls, when the drill pipe passing through the steel ball frame and keeping in contact with the steel balls falls, it drives the steel ball seat to move downwards, and the guide ramp of the steel ball seat, which narrows from top to bottom, gradually pushes the steel balls to move radially inwardly, so that the steel balls clamp the drill pipe to prevent it from continuing falling, which has a good fall prevention effect.

To achieve the above object, the technical solution provided by the invention is a ball-clamp type fall arrester for a drill pipe which includes a base and a steel ball seat arranged in the base. A liftable steel ball frame is arranged in the steel ball seat. A side wall of the steel ball frame is provided with a plurality of limit holes, each of which is provided with a radially movable steel ball. An inner wall of the steel ball seat is provided with a guide ramp. When the steel ball frame is lifted or lowered, the radial positions of the steel balls in the limit holes are positioned by the guide ramp.

As the present invention employs the above technical solutions, the steel balls and the guide ramp of the steel ball seat movably cooperate and resume a clamped or an unclamped state. The ball-clamp type fall arrester for drill pipe is arranged around an outer circumference of the drill pipe when in use, and the steel ball seat is arranged in the base, with the drill pipe passing through the steel ball frame. When the drill pipe damper is unfastened in advance due to equipment failure or operator's misoperation, the drill pipe will fall, and the steel balls and the steel ball frame will fall simultaneously due to their own gravity. The guide ramp of the steel ball seat, which narrows from top to bottom, will gradually push the steel balls radially inwardly and clamp the drill pipe. As the steel ball frame is provided with a plurality of limit holes in which the steel balls are movably positioned, the steel balls can move radially inwardly and clamp the drill pipe with the help of mutual cooperation of the steel balls and the guide ramp of the steel ball seat, to prevent the drill pipe from falling and avoid drill-falling accidents. When lowering the drill tool, a fork used to lift the steel ball frame may be depressed, or the steel ball seat may be lifted by a certain distance with a tool, so that the steel balls will be separated from the narrow guide ramp of the steel ball seat, enabling the steel balls to release the drill pipe, and thus the drill pipe can be moved into the drill hole. A structure that limits the axial movement displacement of the steel balls, such as a snap ring, etc., may be arranged on the steel ball seat. After axially upwardly moving fora certain distance, the steel balls will abut against the snap ring, to limit the distance that the steel ball frame axially outwardly moves for, and thus the steel ball frame will not move out of the steel ball seat.

In some embodiments, at least one circumference of the steel ball frame is provided with steel balls arranged at equal intervals. The steel balls and the limit holes are preferably annularly distributed on a cylindrical wall of the steel ball frame, to achieve better contact clamping between the steel balls and the outer wall of the drill pipe.

In some embodiments, the inner wall of the steel ball seat forms the guide ramp with an inverted conical shape. When the drill pipe passing through the steel ball frame falls, the steel ball frame moves downwards with the steel balls till the steel balls approach the bottom of the inverted conical guide ramp of the steel ball seat, then the steel balls are pushed to move radially and pass through the limit holes, to abut against the drill pipe, and thus stop it from falling.

In some embodiments, the steel ball seat comprises an upper steel ball seat and a lower steel ball seat having identical structures with a wide top and a narrow bottom. The limit holes comprise upper limit holes and lower limit holes provided on the steel ball frame. The upper limit holes may be movably positioned in the upper steel ball seat, and the lower limit holes may be movably positioned in the lower steel ball seat. When the steel balls in the lower limit holes move to the bottom of the lower steel ball seat, they will be radially pushed into an interior of the steel ball frame; and when the steel balls in the lower limit holes move to the top of the lower steel ball seat, they will abut against the bottom of the upper steel ball seat. When raising the drill tool, the steel ball seat may be lifted upwardly by a tool or a fork. The steel balls in the lower limit holes will abut against the bottom of the upper steel ball seat during the upward movement, and thus the distance that the steel ball frame axially outwardly moves for is limited. At this moment, the steel ball frame can no longer move axially upwardly, nor will it move out of the steel ball seat. Then the steel balls release the drill pipe, and the drill pipe can be taken out from the steel ball seat. When the drill pipe happens to fall, it drives the steel balls and the steel ball frame to fall. During the falling process, once the steel balls move axially downwardly to the bottoms of the upper steel ball seat and the lower steel ball seat, the steel balls will clamp the drill pipe, limit its position as well as stop it from falling with the help of inner walls of the upper steel ball seat and the lower steel ball seat, which are wide at the top and narrow at the bottom, providing good protection against the falling of the drill pipe.

In some embodiments, inner sides of the upper limit holes and lower limit holes are respectively provided with a protruding ring that prevents the steel balls from moving out. The protruding ring is used to limit the radial inward movement of the steel balls, and the inner diameter of the protruding ring is smaller than that of the steel balls. The steel ball frame will fall to the bottom of the steel ball seat due to its own gravity in the absence of the drill pipe, and the steel balls will be moved radially inwardly in the limit holes. As the steel balls are blocked by the protruding ring, the steel balls will not move out of the limit holes. The setting of the protruding ring makes the steel balls to be limited between the limit holes and the inner walls of the steel ball seat.

In some embodiments, a rotatable fork may be arranged on a side wall of the base. The top of the steel ball frame is provided with a flange extending radially outwardly. The fork is clamped at the steel ball frame and abuts against the lower side of the flange. When raising or lowering the drill tool, the fork is depressed downwards, and a shift fork of the fork is clamped at the flange at the top of the steel ball frame. The fork is rotationally provided on the base, and when the fork is depressed downwards, the fork lifts the steel ball frame through the shift fork. When the steel ball frame is lifted, the steel balls and the steel ball seat are separated and resume unclamped state, at this moment the drill pipe can be lifted or moved into the drill hole.

In some embodiments, a side wall of the base is provided with a pin hole. An outer wall of the steel ball seat is provided with an outer annular groove. A key pin is arranged in the pin hole, and an end of the key pin is inserted into the outer annular groove. When assembling, the steel ball seat is directly installed in the base, and then the key pin is tightly screwed into the pin hole. When the end of the key pin is inserted into the outer annular groove of the steel ball seat, the steel ball seat is fixed in the base, which has the characteristic of rapid assembly.

The present invention has the following advantages: the safety performance is improved and the fall arrester can be used in cooperation with equipment such as drill pipe damper assemblies to avoid sudden falling accidents; the fall arrester has a novel structure, small size and light weight, which is convenient to assemble and disassemble, and saves labor and costs; and the fall arrester has low production, manufacturing, and usage maintenance costs. The detachable connection of the steel ball seat and the base enables them to be easily replaced, which is compatible to drill pipes of different specifications and sizes. The steel balls are distributed annularly on the side wall of the steel ball frame and abut against the steel ball seat, which can clamp the drill pipe better and prevent it from falling, resulting in a better fall prevention effect.

REFERENCE NUMERALS

Figure 1:
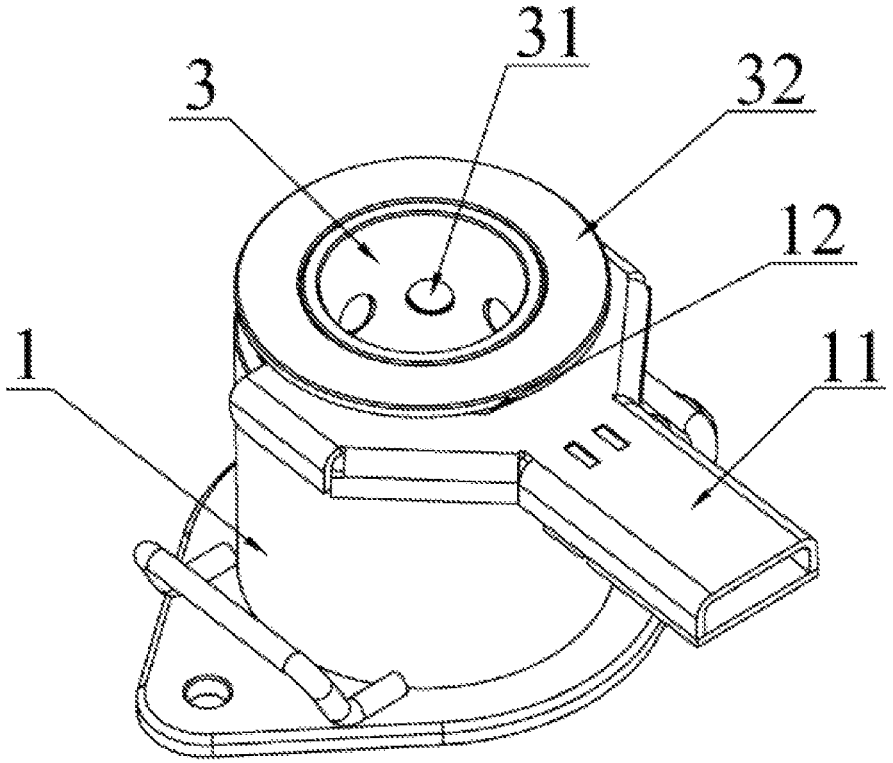
FIG. 1 is a schematic perspective structure view of an embodiment of the present invention in a clamped state.
Figure 2:
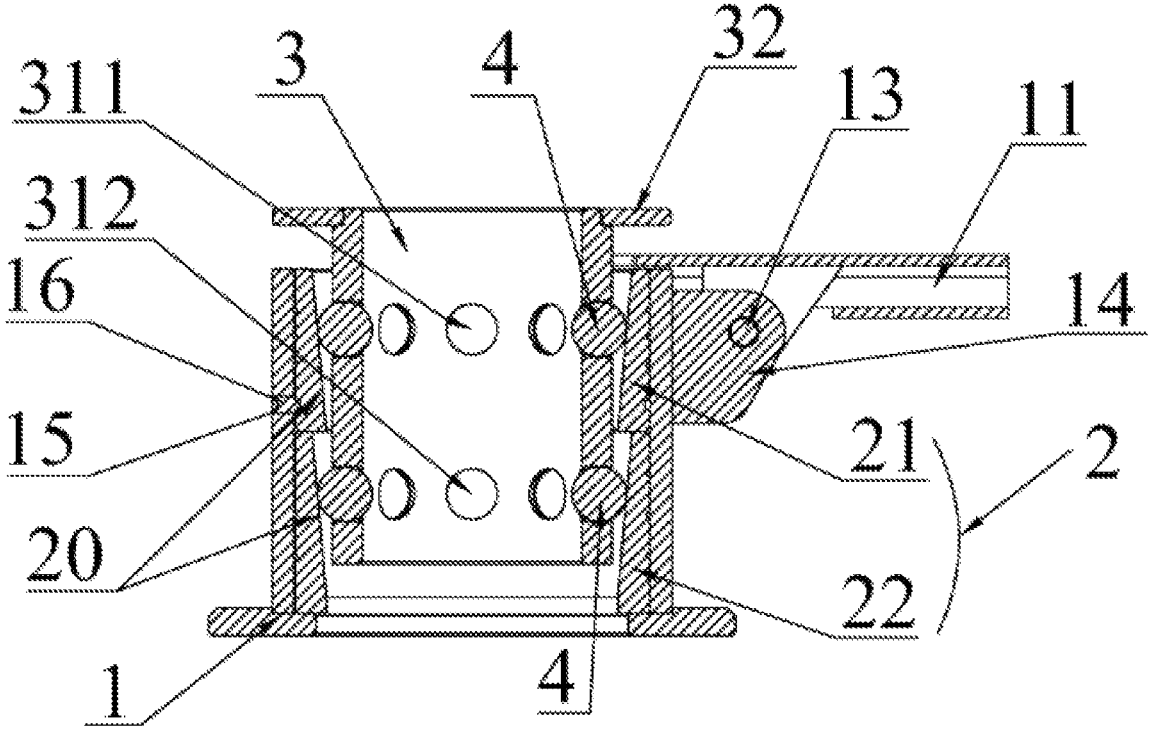
FIG. 2 is a schematic cross-sectional structural view of an embodiment of the present invention in a clamped state.
Figure 3:
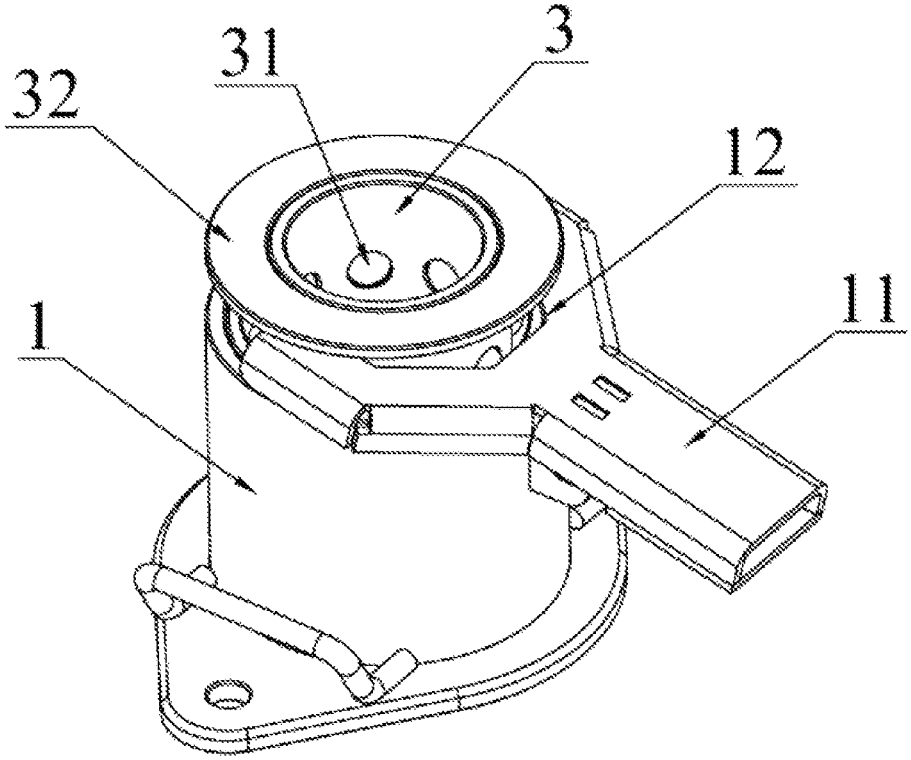
FIG. 3 is a schematic perspective structure view of an embodiment of the present invention in an unclamped state.
Figure 4:
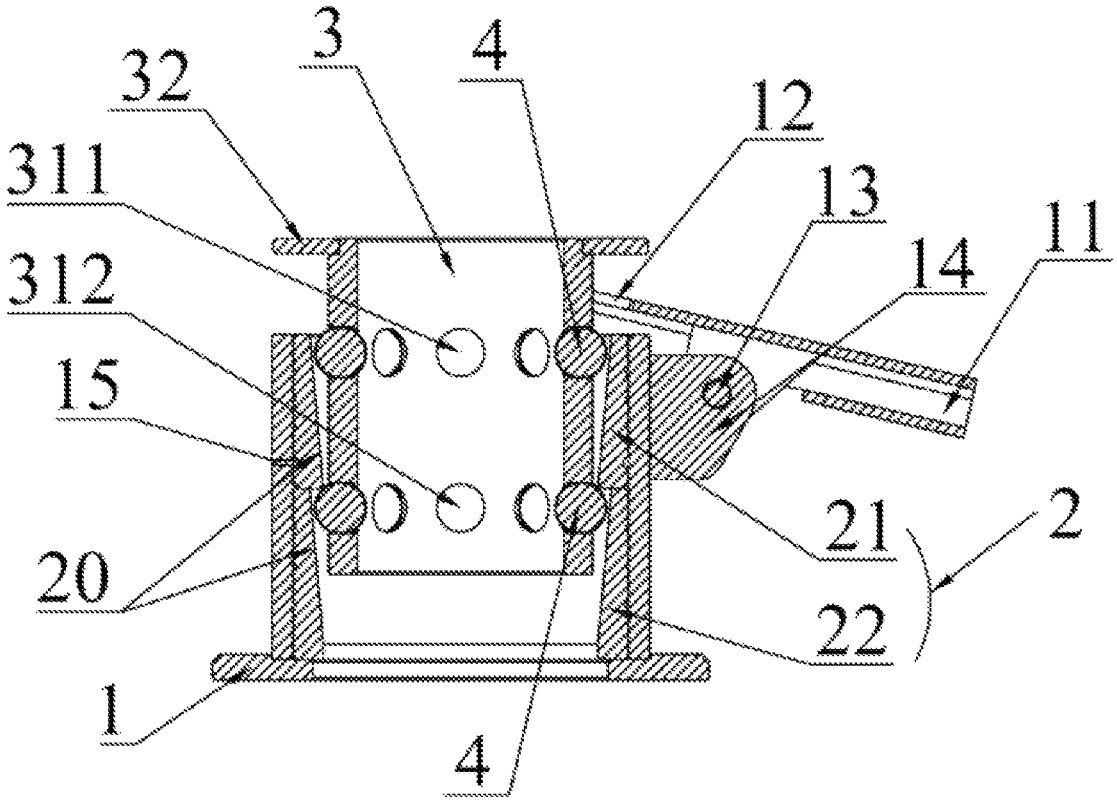
FIG. 4 is a schematic cross-sectional structural view of an embodiment of the present invention in an unclamped state.
Figure 5:
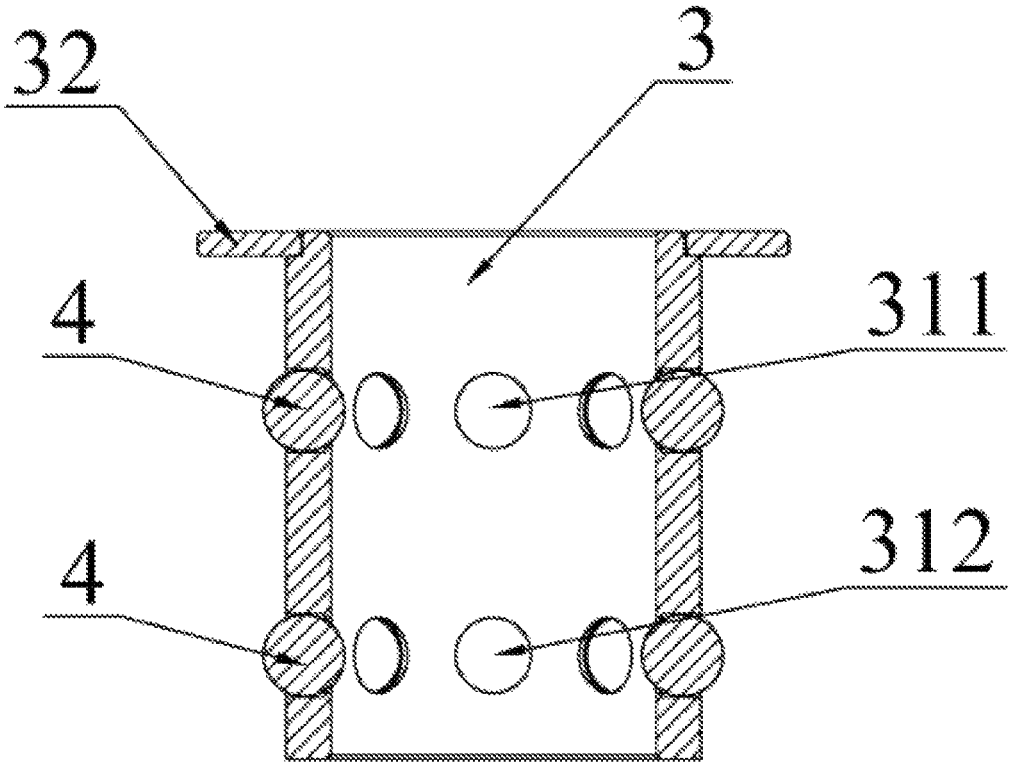
FIG. 5 is a schematic cross-sectional structural view of a steel ball frame of an embodiment of the present invention.
Figure 6:
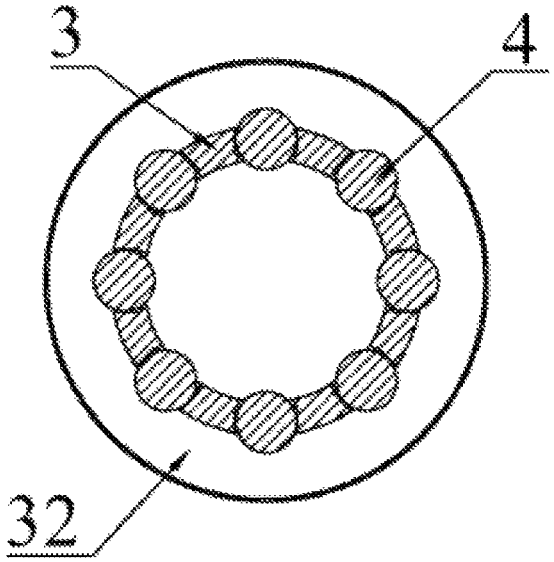
FIG. 6 is a schematic cross-sectional structural view of a steel ball frame of an embodiment of the present invention from another aspect.
Figure 7:
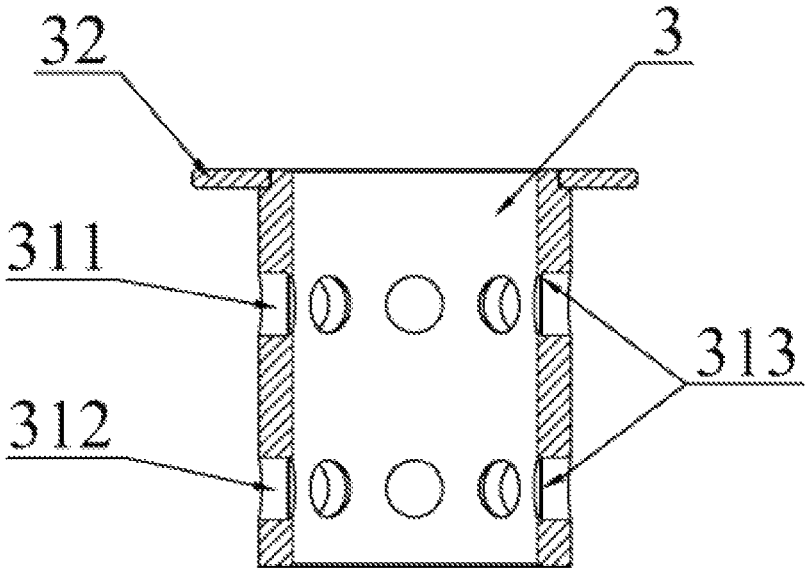
FIG. 7 is a schematic cross-sectional structural view of a steel ball frame of an embodiment of the present invention in which steel balls are omitted for clarity.
Figure 8:
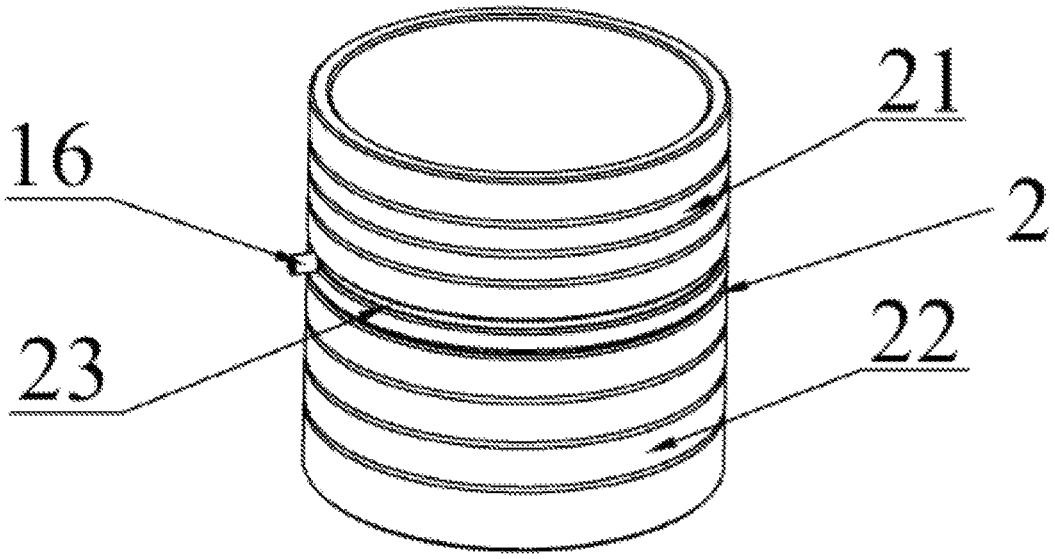
FIG. 8 is a schematic structure view of a steel ball seat of an embodiment of the present invention.
Figure 9:
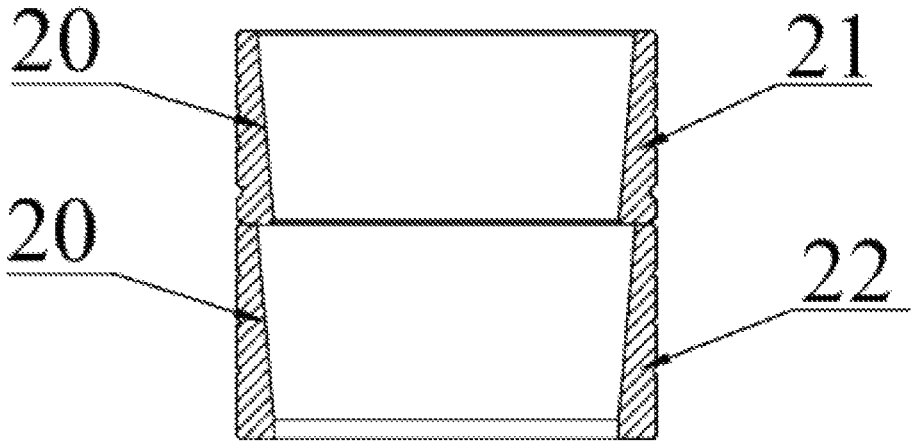
FIG. 9 is a schematic cross-sectional structural view of a steel ball seat of an embodiment of the present invention.

1. base; 11. fork; 12. shift fork; 13. pin; 14. support plate; 15. pin hole; 16. key pin;
2. steel ball seat; 20. guide ramp; 21. upper steel ball seat; 22. lower steel ball seat; 23. outer annular groove;
3. steel ball frame; 31. limit hole; 311. upper limit hole; 312. lower limit hole; 313. protruding ring; 32. flange;
4. steel ball;
5. drill pipe.

DESCRIPTION OF THE EMBODIMENTS

The present invention is further described in combination with the accompanying drawings and specific embodiments.

As shown in FIGS. 1 to 11, a ball-clamp type fall arrester for a drill pipe includes a base 1 and a steel ball seat 2 which is arranged in the base 1. A liftable steel ball frame 3 is arranged in the steel ball seat 2. A side wall of the steel ball frame 3 is provided with a plurality of limit holes 31. An inner wall of the steel ball seat 2 is provided with a guide ramp 20. Steel balls 4 are arranged in the limit holes 31 and are radially movable. When the steel ball frame 3 is lifted or lowered, the radial positions of the steel balls 4 in the limit holes 31 are positioned by the guide ramp 20.

At least one circumference of the steel ball frame 3 is provided with several steel balls 4 arranged at equal intervals. The inner wall of the steel ball seat 2 forms the guide ramp 20 of an inverted conical shape.

The steel balls 4 and the guide ramp 20 of the steel ball seat 2 movably cooperate and resume a clamped state or an unclamped state. The steel ball frame 3 is positioned in the steel ball seat 2. The side wall of the steel ball frame 3 is provided with the limit holes 31, in which movable steel balls 4 are arranged. The steel balls 4 are lifted or lowered with the limit holes 31 during the axial upward or downward movement of the steel ball seat 3. When the steel balls 4 are lowered, they come into contact with the guide ramp 20 of the inner wall of the steel ball seat 2. By the contact cooperation with the inverted conical inner wall of the steel ball seat 2, which narrows from top to bottom, the steel balls 4 move radially inwardly, and they partly pass through the limit holes 31 and then abut an outer wall of the drill pipe 5 that passes through the steel ball frame 3, clamping the drill pipe 5 to prevent it from falling. Due to the cooperation of the drill pipe 5 and the guide ramp 20 of the inner wall of the steel ball seat 2, the steel balls 4 are in the clamped state when moving to the bottom of the steel ball seat 2, and in the unclamped state when moving to the top of the steel ball seat 2.

In the present embodiment, the steel ball seat 2 includes an upper steel ball seat 21 and a lower steel ball seat 22 having identical structures with a wide top and a narrow bottom. The limit holes 31 includes upper limit holes 312 and lower limit holes 312 provided on the steel ball frame 3, wherein the upper limit holes 311 is movably positioned in the upper steel ball seat 21, and the lower limit hole 312 is movably positioned in the lower steel ball seat 22. The upper steel ball seat 21 and the lower steel ball seat 22 have identical structures with an inverted conical guide ramp 20 that is wide at the top and narrow at the bottom. When installed in the base 1, the upper steel ball seat 21 is located above the lower steel ball seat 22, with the larger diameter ends of both facing upwards. The limit holes 31 of the steel ball frame 3 are arranged in two rows, i.e., the upper limit holes 311 and the lower limit holes 312. The axial positions of the upper limit holes 311 are limited by the axial length of the upper steel ball seat 21, and the axial positions of the lower limit holes 312 are limited by the axial length of the lower steel ball seat 22. When raising the drill pipe, the steel ball seat 3 is lifted axially, and the steel balls 4 move in the upper limit holes 311 and the lower limit holes 312 axially and outwardly. When the steel balls 4 move to the larger diameter ends of the upper steel ball seat 21 and the lower steel ball seat 22, the steel balls 4 are separated from the drill pipe 5 and resume in the unclamped state, and thus the drill pipe 5 can be taken out from the steel ball frame 3. During the axial upward movements of the steel balls 4, when the steel balls 4 in the lower limit holes 312 move to the bottom of the upper steel ball seat 21, they will abut against the bottom of the upper steel ball seat 21 to prevent the steel ball frame 3 from continuing moving out axially, and thus to prevent the steel ball frame 3 and the steel balls 4 from moving out of the base 1 which plays a role in limiting and protecting the steel ball frame 3 from moving out of the steel ball seat 2. When the drill pipe 5 falls, it drives the steel balls 4 and the steel ball frame 3 to move axially downwardly, and the steel balls 4 contact with the inverted conical inner walls of the upper steel ball seat 21 and the lower steel ball seat 22. During the downward movements, the steel balls 4 keep clamping the drill pipe 5 in cooperation with the inverted conical surface inner wall of the upper steel ball seat 21 and the lower steel ball seat 22, such that the steel balls 4 are in the clamped state, and thus the drill pipe 5 is clamped.

The inner sides of upper limit holes 311 and lower limit holes 312 are respectively provided with protruding rings 313 to prevent the steel balls 4 from moving out. The inner diameter of the protruding rings 313 is smaller than that of the steel balls 4. In the state without the drill pipe 5, the steel ball frame 3 will fall to the bottom of the steel ball seat 2 due to its own gravity, and the steel balls 4 will move radially inward along the limit holes 31. The protruding rings 313 can prevent the steel balls 4 from moving out of the limit holes 31 and falling into the drill hole.

A side wall of the base 1 is provided with a rotatable fork 11. The top of the steel ball frame 3 is provided with a flange 32 extending radially outwardly. The front end of the fork 11 is provided with a shift fork 12, which is clamped at the steel ball frame 3 and abuts against the lower side of the flange 32. Specifically, the side wall of the base 1 extends outwardly to form a support plate 14, and the fork 11 is rotatably connected to the support plate 14 through a pin 13. When raising the drill pipe, the fork 11 is depressed downwards, with the pin 13 serving as a fulcrum, and a front end of the fork 11 will move upwards. The steel ball frame 3 can be lifted through the shift fork 12 clamped under the flange 32. When the steel ball frame 3 is lifted, it will drive the steel balls 4 to move axially upwardly, and the steel balls 4 will gradually move to the inner walls with a larger inner diameter of the upper steel ball seat 21 and the lower steel ball seat 22. At this time, the upper steel ball seat 21 and the lower steel ball seat 22 have no restriction on the steel balls 4. Thus, the steel balls 4 are in the unclamped state, the drill pipe 5 is unclamped and it can be taken out of the steel ball frame 3.

The side wall of the base 1 is provided with a pin hole 15. An outer wall of the steel ball seat 2 is provided with an outer annular groove 23. The pin hole 15 is inserted with a key pin 16, and the end of the key pin 16 is inserted into the outer annular groove 23. During assembly, the lower steel ball seat 22 is first placed into the base 1, and then the upper steel ball seat 21. The upper steel ball seat 21 is arranged above the lower steel ball seat 22. The key pin 16 is tightly screwed in the pin hole 15, and the key pin 16 is fastened on the upper steel ball seat 21, thus the upper steel ball seat 21 and the lower steel ball seat 22 can be fixed in the base 1 simultaneously. The key pin 16 can also be inserted into the outer annular groove 23 of the upper steel ball seat 21 and the lower steel ball seat 22 simultaneously, locking the upper steel ball seat 21 and the lower steel ball seat 22. In other embodiments, the steel ball seat 2 and the base 1 can also be assembled through thread connection.

Figure 10:
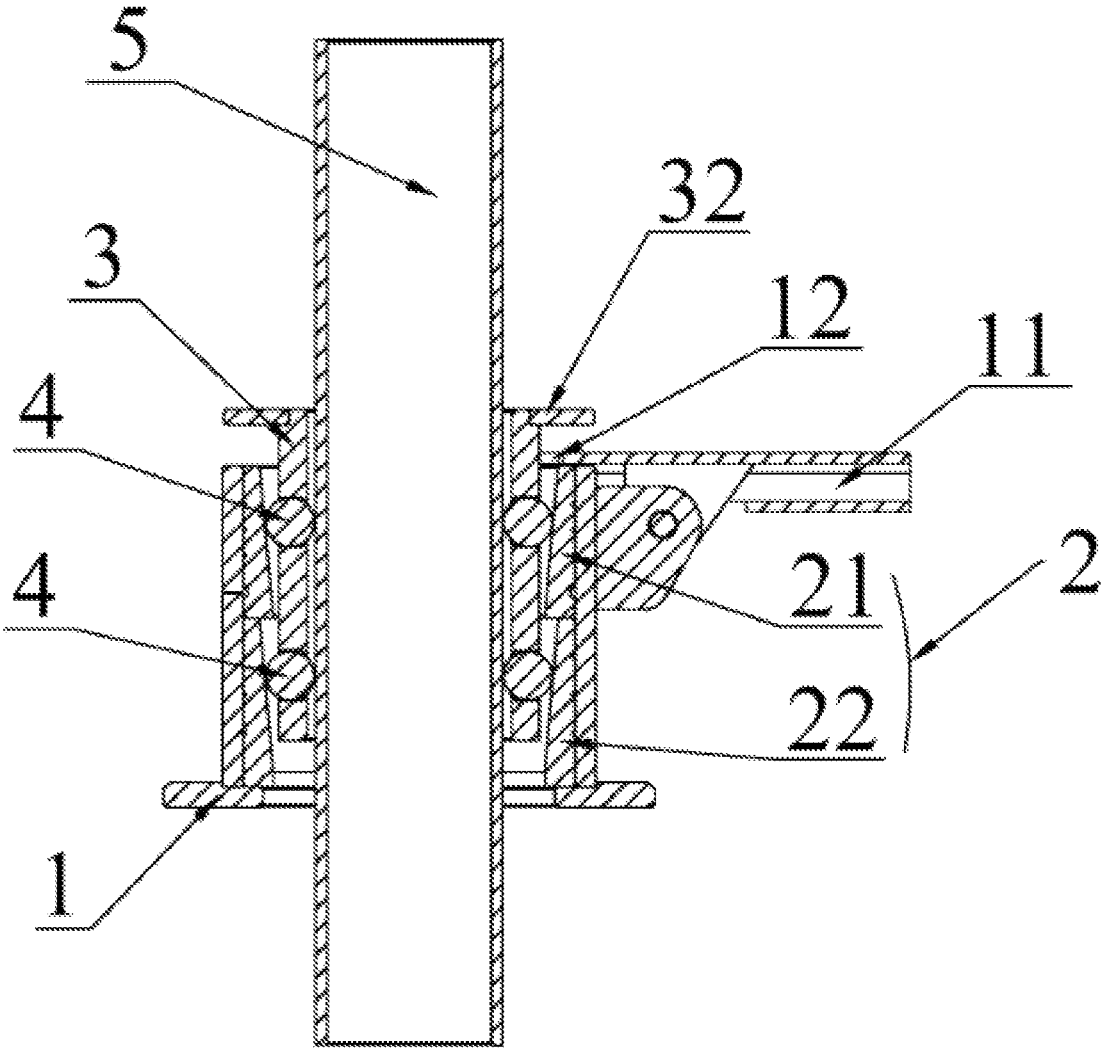
FIG. 10 is a schematic cross-sectional structural view of an embodiment of the present invention in a clamped state with a specific implementation.

During a specific implementation of the present invention, as shown in FIG. 10, which is a schematic cross-sectional structural view of an embodiment of the present invention in a clamped state with a specific implementation, the fall arrester is mounted around an outer circumference of the drill pipe 5. Under normal conditions, the steel ball frame 3 is located below the steel ball seat 2 due to its own gravity and thus contacts the drill pipe 5. The steel balls 4 maintain point contact with the drill pipe 5, and the steel balls 4 can rotatably support the outer wall of the drill pipe 5 during the normal drilling of the drill pipe 5.

When a drill-falling occurs, the drill pipe 5 falls, and it keeps contact with the steel balls 4 and drives the steel balls 4 as well as the steel ball frame 3 to fall, and the steel ball frame 3 axially moves downwardly from the original position. During the moving process, the steel balls 4 are limited by the gradually narrowed guide ramps 20 of the upper steel ball seat 21 and the lower steel ball seat 22, so that the steel balls 4 continue moving radially towards the outer wall of the drill pipe 5 in the process moving downwardly. During the downward and radially inward movement of the steel balls 4, the radial force of the steel balls 4 contacting and clamping the drill pipe 5 gradually increases until the drill pipe 5 is locked. By the cooperation of the steel balls 4 and the steel ball seat 2, the purpose of clamping the drill pipe 5 is achieved, which can effectively prevent the drill pipe 5 from suddenly falling, and has high safe performance in use.

Figure 11:
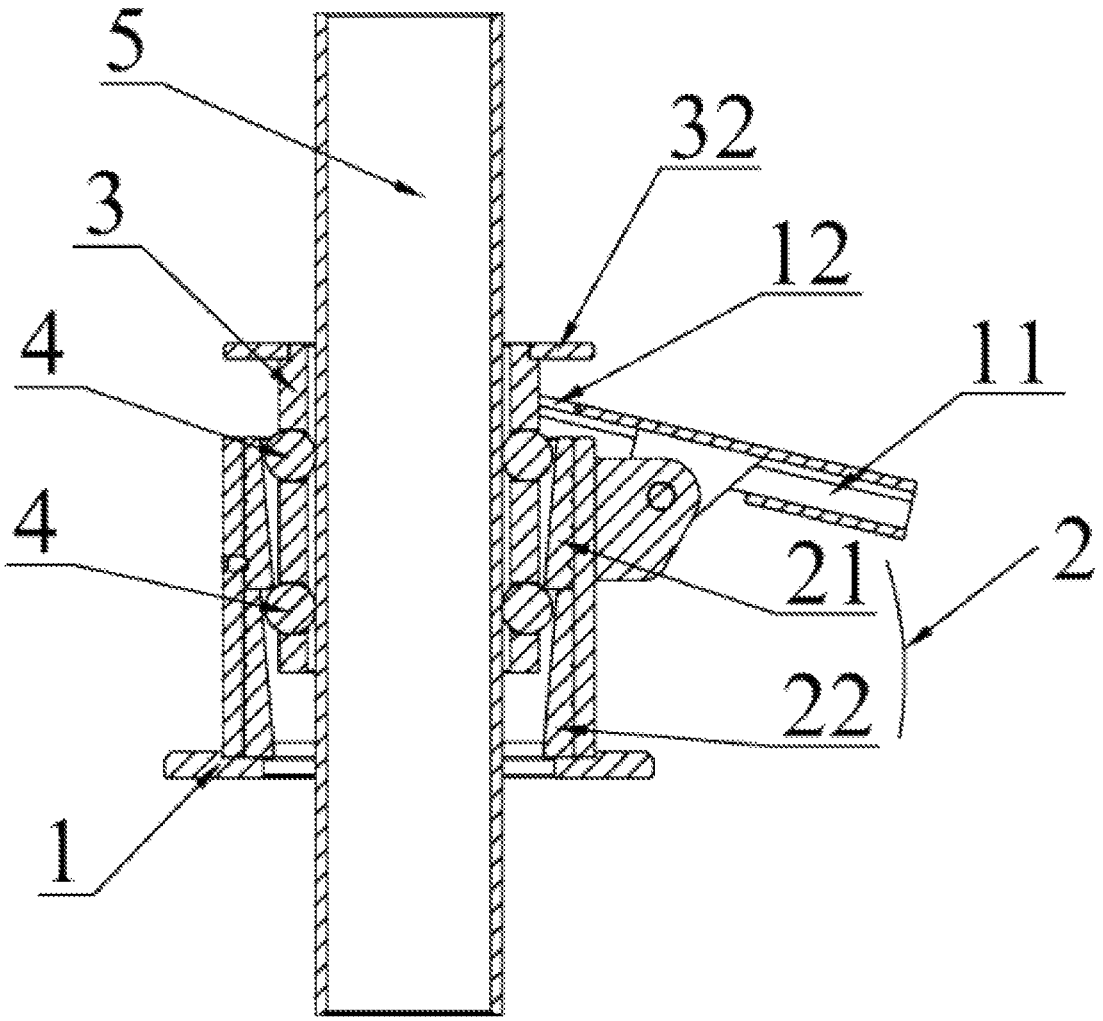
FIG. 11 is a schematic cross-sectional structural view of an embodiment of the present invention in an unclamped state with a specific implementation.

As shown in FIG. 11, shown is a schematic cross-sectional structural view of an embodiment of the present invention in an unclamped state with a specific implementation. When raising the drill pipe, the fork 11 is depressed downwardly, and the shift fork 12 of the fork 11 moves up to lift the steel ball frame 3 upwardly. During the axial upward movement of steel ball frame 3, it drives the steel balls 4 to move axially upwardly. During the upward movement of the steel balls 4, they gradually separate from the guide ramps 20 of the inner walls of the upper steel ball seat 21 and the lower steel ball seat 22. The steel balls 4 in the lower limit holes 312 move upwardly until contacting the bottom of the upper steel ball seat 21. The upper steel ball seat 21 limits the steel balls 4 and the steel ball frame 3 from moving outwardly, to prevent the steel ball frame 3 from moving out of the base 1. During the upward movements of the steel balls 4, the clamping force on the drill pipe 5 is gradually reduced. When the steel balls 4 release the drill pipe 5, the drill pipe 5 can be taken out of the steel ball frame 3.

In summary, the present invention has been made into actual samples and undergone multiple usage tests as the description and illustrations describe. From the results of the usage tests, it can be proven that the present invention can achieve its intended purpose, and its practical value is beyond doubt. The above-mentioned embodiments are only used to illustrate the present invention for convenience, and are not intended to limit the present invention in any form. Any equivalent embodiments obtained by those of ordinary skill in the art by partially modifying or changing the technical content disclosed in the present invention without departing from the technical features of the disclosure all fall within the scope of the disclosure.

What is claimed is:

1. A ball-clamp type fall arrester for a drill pipe, comprising a base (1) and a steel ball seat (2) arranged in the base (1), wherein the steel ball seat (2) is provided with a liftable steel ball frame (3), a side wall of the steel ball frame (3) is provided with a plurality of limit holes (31), an inner wall of the steel ball seat (2) is provided with a guide ramp (20), each limit hole (31) is provided with a steel ball (4) which is movable radially, and wherein when the steel ball frame (3) is lifted or lowered, a radial position of each steel ball (4) in a corresponding limit hole (31) is positioned by the guide ramp (20), wherein the base (1) is provided with a fork (11), which is rotatably arranged on the base (1) through a pin (13), a top of the steel ball frame (3) is provided with a flange (32) extending radially outwardly, a front end of the fork (11) is clamped at the steel ball frame (3) and abuts against the flange (32).

2. The ball-clamp type fall arrester for a drill pipe according to claim 1, wherein at least one circumference of the steel ball frame (3) is provided with steel balls (4) arranged at equal intervals.

3. The ball-clamp type fall arrester for a drill pipe according to claim 1, wherein the inner wall of the steel ball seat (2) forms the guide ramp (20) of an inverted conical shape.

4. The ball-clamp type fall arrester for a drill pipe according to claim 1, wherein the steel ball seat (2) comprises an upper steel ball seat (21) and a lower steel ball seat (22) having identical structures with a wide top and a narrow bottom, and the limit holes comprise a plurality of upper limit holes (311) provided at the upper steel ball seat (21) and a plurality of lower limit holes (312) provided at the lower steel ball seat (22).

5. The ball-clamp type fall arrester for a drill pipe according to claim 4, wherein an inner side of each of the upper limit holes (311) and the lower limit holes (312) is provided with a protruding ring (313) to prevent a corresponding steel ball (4) from moving out.

6. The ball-clamp type fall arrester for a drill pipe according to claim 2, wherein the steel ball seat (2) comprises an upper steel ball seat (21) and a lower steel ball seat (22) having identical structures with a wide top and a narrow bottom, and the limit holes comprise a plurality of upper limit holes (311) provided at the upper steel ball seat (21) and a plurality of lower limit holes (312) provided at the lower steel ball seat (22).

7. The ball-clamp type fall arrester for a drill pipe according to claim 1, wherein a side wall of the base (1) is provided with a pin hole (15), an outer wall of the steel ball seat (2) is provided with an outer annular groove (23), a key pin (16) is provided in the pin hole (15), and an end of the key pin (16) is inserted into the outer annular groove (23).

8. A ball-clamp type fall arrester for a drill pipe, comprising a base (1) and a steel ball seat (2) arranged in the base (1), wherein the steel ball seat (2) is provided with a liftable steel ball frame (3), a side wall of the steel ball frame (3) is provided with a plurality of limit holes (31), an inner wall of the steel ball seat (2) is provided with a guide ramp (20), each limit hole (31) is provided with a steel ball (4) which is movable radially, and wherein when the steel ball frame (3) is lifted or lowered, a radial position of each steel ball (4) in a corresponding limit hole (31) is positioned by the guide ramp (20), wherein a side wall of the base (1) is provided with a pin hole (15), an outer wall of the steel ball seat (2) is provided with an outer annular groove (23), a key pin (16) is provided in the pin hole (15), and an end of the key pin (16) is inserted into the outer annular groove (23).

9. The ball-clamp type fall arrester for a drill pipe according to claim 8, wherein at least one circumference of the steel ball frame (3) is provided with steel balls (4) arranged at equal intervals.

10. The ball-clamp type fall arrester for a drill pipe according to claim 9, wherein the steel ball seat (2) comprises an upper steel ball seat (21) and a lower steel ball seat (22) having identical structures with a wide top and a narrow bottom, and the limit holes comprise a plurality of upper limit holes (311) provided at the upper steel ball seat (21) and a plurality of lower limit holes (312) provided at the lower steel ball seat (22).

11. The ball-clamp type fall arrester for a drill pipe according to claim 8, wherein the inner wall of the steel ball seat (2) forms the guide ramp (20) of an inverted conical shape.

12. The ball-clamp type fall arrester for a drill pipe according to claim 8, wherein the steel ball seat (2) comprises an upper steel ball seat (21) and a lower steel ball seat (22) having identical structures with a wide top and a narrow bottom, and the limit holes comprise a plurality of upper limit holes (311) provided at the upper steel ball seat (21) and a plurality of lower limit holes (312) provided at the lower steel ball seat (22).

13. The ball-clamp type fall arrester for a drill pipe according to claim 12, wherein an inner side of each of the upper limit holes (311) and the lower limit holes (312) is provided with a protruding ring (313) to prevent a corresponding steel ball (4) from moving out.

* * * * *